US006830314B2

(12) United States Patent
Nakashima

(10) Patent No.: US 6,830,314 B2
(45) Date of Patent: Dec. 14, 2004

(54) INKJET RECORDING APPARATUS

(75) Inventor: Atsuhisa Nakashima, Handa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/454,534

(22) Filed: Jun. 5, 2003

(65) Prior Publication Data

US 2003/0227514 A1 Dec. 11, 2003

(30) Foreign Application Priority Data

Jun. 11, 2002 (JP) ..... 2002-169642

(51) Int. Cl.[7] ..... B41J 2/155
(52) U.S. Cl. ..... 347/42
(58) Field of Search ..... 347/42, 31, 90, 347/34

(56) References Cited

U.S. PATENT DOCUMENTS

| | | | | |
|---|---|---|---|---|
| 5,717,446 | A | 2/1998 | Teumer et al. | |
| 5,734,394 | A * | 3/1998 | Hackleman | 347/42 |
| 6,561,632 | B2 * | 5/2003 | Feinn et al. | 347/65 |
| 2002/0018097 | A1 | 2/2002 | Kitahara et al. | |
| 2002/0044168 | A1 | 4/2002 | Hashi et al. | |

FOREIGN PATENT DOCUMENTS

| | | | |
|---|---|---|---|
| DE | 38 12 462 A1 | | 10/1989 |
| EP | 0 707 973 A2 | | 4/1996 |
| JP | 63160850 | * | 7/1988 |
| JP | 2208084 | * | 8/1990 |
| JP | 182988 | * | 7/1994 |
| JP | 2801231 | * | 9/1998 |
| JP | 2915635 | * | 7/1999 |
| JP | 071521 | * | 3/2001 |
| JP | 088375 | * | 4/2001 |
| JP | 162870 | * | 6/2001 |

* cited by examiner

*Primary Examiner*—Thinh Nguyen
(74) *Attorney, Agent, or Firm*—Oliff & Berridge, PLC

(57) ABSTRACT

An inkjet recording apparatus is provided with at least one inkjet head having a plurality of groups of nozzles that eject the ink, and a platen closely arranged to face the at least one inkjet head. The plurality of groups of the nozzles are arranged in a width direction of the recording medium with predetermined clearances therebetween, and parts of the plurality of groups overlap when viewed from a direction in which the recording medium is fed so that the plurality of groups are continuously provided as a whole. Further, a plurality of protrusions are formed on the main body of the platen at locations facing the clearances between the plurality of groups of the inkjet head.

19 Claims, 4 Drawing Sheets

INKJET RECORDING APPARATUS

BACKGROUND OF THE INVENTION

The present invention relates to an inkjet recording apparatus, and more particularly to an inkjet recording apparatus having a so-called linear inkjet head.

Recently, inkjet printers have been widespread since they generate less noise, and use standard paper as recording medium. A conventional inkjet printer typically employs a movable inkjet head which sweeps in a width direction (main sweeping direction) of the recording medium, which moves relative to the inkjet head in a direction (auxiliary sweeping direction) perpendicular to the main sweeping direction to form a two-dimensional image on the recording medium. Such an inkjet head is referred to as a serial type inkjet head.

In such an inkjet printer, since the inkjet head moves, an image forming speed is limited to a certain level, and is difficult to meet a recent demand of high-speed imaging. To meet such a demand, usage of a linear inkjet head attracts attention. The linear inkjet head is provided with a plurality of ink ejecting nozzles arranged in a width direction (i.e., the main sweeping direction) of the recording medium. Typically, the linear inkjet head is fixed at a predetermined position of the printer, while the recording medium is driven to move at a high speed in the auxiliary sweeping direction, thereby the imaging speed being greatly accelerated.

Incidentally, ink residing at the ink ejecting nozzles of the inkjet head tends to dry easily since it is exposed to the air. Therefore, before a printing job, and may also be during the printing job, a flushing operation for forcibly removing the residual ink at the ink ejecting nozzles may be performed.

If the inkjet head is a serial type (i.e., the movable type), a flushing position is defined, which is a position outside an imaging area for the recording medium, and the flushing operation is performed with the inkjet head located at the flushing position.

However, if the inkjet head is a linear head, it is difficult to perform the flushing operation by moving the inkjet head to a position outside the imaging area of the recording medium since a wide space for allowing the inkjet head to move and a highly accurate driving mechanism to move the inkjet head between the imaging position and a flushing position should be provided. A method in which a member that collects the forcibly discharged ink is moved to the inkjet head at every flushing operation has once been suggested. However, such a method also requires a space and a mechanism for moving the ink collecting member. Further, it takes time to execute such a flushing operation, and is not suitable for the purpose of improving the imaging speed.

Japanese Patent Provisional Application No. 2001-71521 shows an exemplary configuration to cope with such a problem. In this publication, a rotatable cylindrical member having a slot, which is through-bored along the diameter and is elongated in the axial direction of the cylindrical member, is provided immediately below an inkjet head. Further, an ink absorbing member is provided so as to face the inkjet head with the rotatable cylindrical member therebetween. When the flushing operation is performed, the rotatable cylindrical member is rotated so that the inkjet head and the ink absorbing member face each other through the slot, and the ink discharged by the inkjet head is absorbed by the ink absorbing member.

Another configuration disclosed in Japanese Patent Provisional Publication No. HEI 63-160850 includes an ink absorbing member which faces the ink ejecting orifices, and a retractable platen is provided between the inkjet head and the ink absorbing member. In this configuration, when the flushing is performed, the platen is retracted from the position between ink ejecting orifices and the ink absorbing member so that the ejected ink is absorbed by the ink absorbing member.

Even in the configurations disclosed in the above publications, operations dedicated only to the flushing operation are required, and it may take several seconds to perform the flushing operation. If, for example, an imaging speed of an inkjet printer is 120 sheets/minute, and a flushing operation is performed at every completion of imaging on a sheet, the imaging speed is decelerated to approximately 20 sheets/minute due to the flushing operations. Thus, image formation speed is fast but the effective imaging speed including the flushing operation cannot be sufficiently accelerated.

As such, an improved inkjet recording apparatus which can execute the flushing operation without decelerating the recording speed has been desired.

SUMMARY OF THE INVENTION

The present invention is advantageous in that an inkjet recording apparatus employing a linear inkjet head and is capable of performing a flushing operation without decelerating an imaging operation can be provided.

According to an aspect of the invention, there is provided an inkjet recording apparatus that records an image on recording medium, the recording medium being fed in a predetermined direction which is perpendicular to a width direction of the recording medium, which is provided with at least one inkjet head having a plurality of groups of nozzles that eject the ink, and a platen closely arranged to face the at least one inkjet head, the platen having a main body. The plurality of groups of the nozzles are arranged in a width direction of the recording medium with predetermined clearances therebetween, and parts of the plurality of groups overlap when viewed from a direction in which the recording medium is fed so that the plurality of groups are continuously provided as a whole. Further, a plurality of protrusions are formed on the main body of the platen at locations facing the clearances between the plurality of groups of the inkjet head.

When the flushing operation is performed, the ink is ejected from the nozzle groups toward platen at portions other than the protrusions, while when the imaging operation is performed, the recording medium is supported by the protrusions. Thus, the flushing operation can be performed without requiring a dedicated moving mechanism such as the ink collecting device or moving the inkjet head to a particular position for the flushing. Accordingly, the flushing operation can be performed within a relatively short period of time, and the effective imaging speed of the inkjet recording apparatus will not be significantly decreased.

Optionally, ink absorbing members may be arranged on the main body at locations facing the groups of inkjet nozzles, ink ejected from the plurality of groups being absorbed by the ink absorbing members.

Alternatively, the main body may be formed with through-openings at locations corresponding to the plurality of nozzles of the inkjet head, and the ink ejected from the plurality of nozzles is removed through the through-openings.

Optionally, a plurality of ink absorbing members may be provided at the plurality of through-openings, respectively.

Further optionally, a suction device may be connected to the main body, the ink ejected by the plurality of groups of nozzles being removed by suction through the through-openings.

Still optionally, side surfaces of each of the protrusions may be configured to have water-shedding property.

Further, an upper surface of each of the protrusion may also be configured to have a water-shedding property.

Optionally, an upper surface of each protrusion may be configured to incline upward along a feeding direction of the recording medium.

BRIEF DESCRIPTION OF THE ACCOMPANYING DRAWINGS

FIG. 1 schematically shows a structure of an inkjet recording apparatus according to an embodiment of the invention;

DESCRIPTION OF THE EMBODIMENTS

Hereinafter, an embodiment according to the invention will be described with reference to the accompanying drawings.

Figure 1:
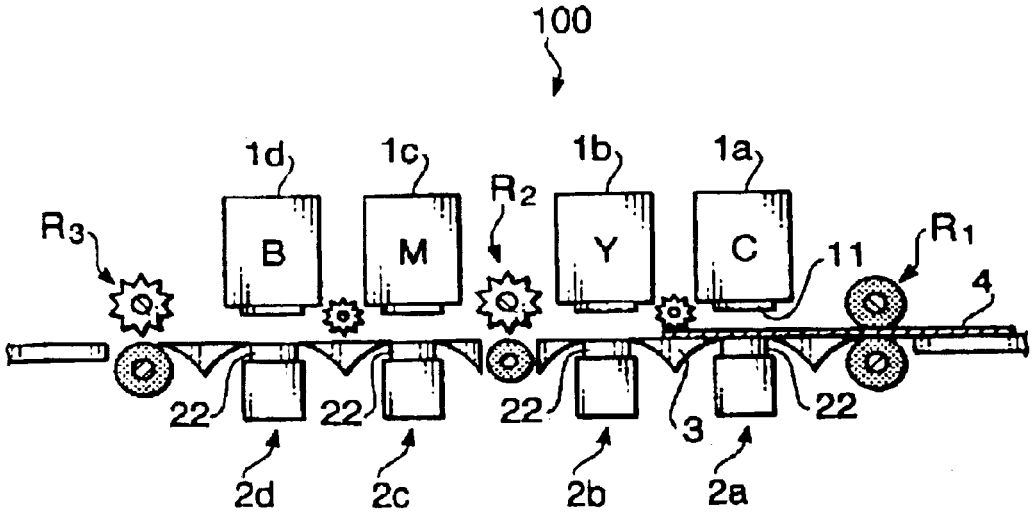

FIG. 1 schematically shows a structure of an inkjet recording apparatus 100 according to an embodiment of the invention.

The inkjet recording apparatus 100 is provided with linear inkjet heads 1*a*, 1*b*, 1*c* and 1*d* for ejecting cyan, yellow, magenta and black inks, respectively. It should be noted that, since structures of the inkjet head 1*a*–1*d* are the same, they will occasionally be represented by one inkjet head and referred to as the inkjet head 1 in the following description. The inkjet heads 1*a*–1*d* are arranged in a direction where recording medium 4 is fed.

As shown in FIG. 1, the inkjet recording apparatus 100 is further provided with platen members 2*a*, 2*b*, 2*c* and 2*d*, which face the linear inkjet heads 1*a*, 1*b*, 1*c* and 1*d*, respectively. Similarly to the inkjet heads 1*a*–1*d*, since the structures of the platen members 2*a*–2*d* are the same, they will occasionally be represented by one platen member which will be referred to as the platen member 2 in the following description.

The recording medium 4, which is typically a sheet of paper, is fed between the inkjet head 1 and the platen member 2 by a pair or feeding rollers R1, fed from the right-hand side to the left-hand side in FIG. 1 with an assist of intermediate rollers R2, and then discharged to outside by a pair of discharge rollers R3. While the recording medium 4 is fed, each inkjet head 1 is driven to eject the ink so that a two-dimensional color image is formed on the recording medium 4. In FIG. 1, numeral 3 denotes a part of a frame supporting the platens 2*a*–2*d*. The upper surface of the frame 3 defines a feed path of the recording medium 4.

Figure 2A:
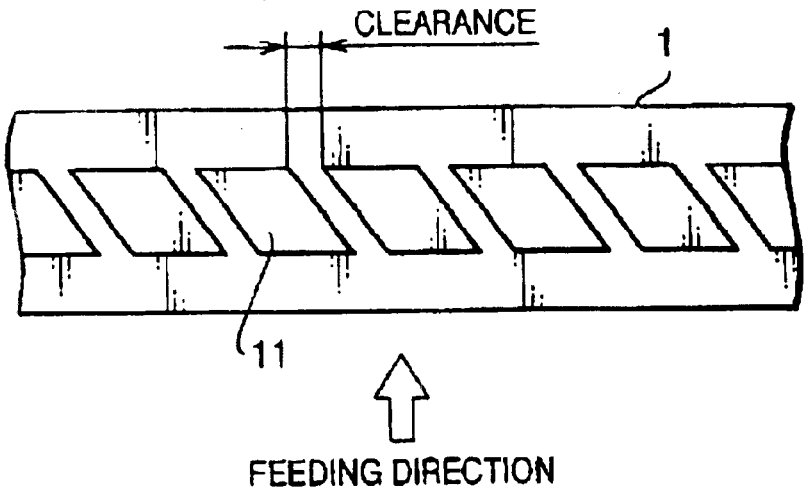
FIGS. 2A through 2C show bottom plan views of parts of inkjet heads formed with ink ejecting nozzles, respectively.
Figure 2B:
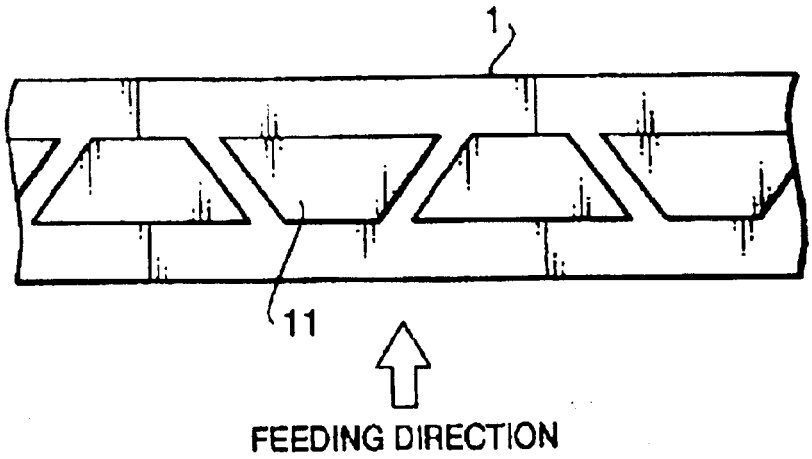
Figure 2C:
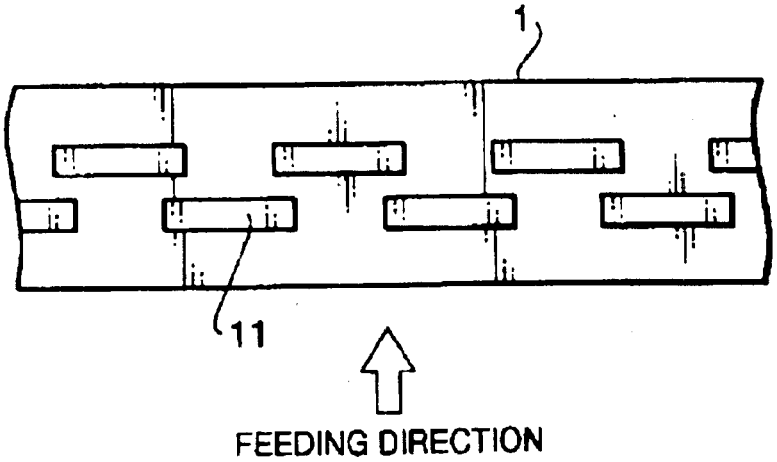

FIGS. 2A through 2C show bottom plan views of parts of three examples of inkjet heads 1 formed with different ink ejecting nozzles, respectively. It should be noted that each of the configurations shown in FIGS. 2A–2C is applicable to each of the inkjet heads 1*a*–1*d*.

In each of FIGS. 2A–2C, numeral 11 denotes a group of nozzles arranged within a figure indicated by the numeral. The groups 11 of the nozzles are arranged in a width direction of the recording medium 4 with predetermined clearances therebetween. Further, when viewed along a feeding direction of the recording medium 4, the adjoining nozzle groups 11 partially overlap so that, as a whole, all the nozzle groups 11 are continuously arranged. Namely, a side portion of one nozzle group 11 and a side portion of the next nozzle group 11 overlap in the width direction of the recording medium, and therefore, all the nozzle groups 11 partially overlap along the width direction when viewed from the feeding direction of the recording medium 4.

Figure 3A:
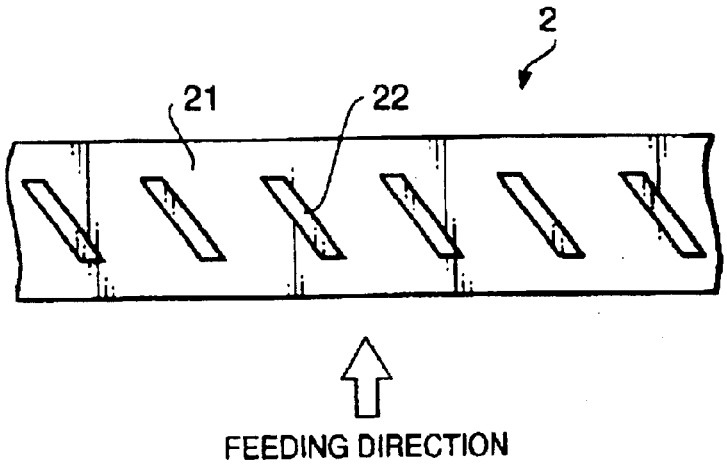
FIGS. 3A through 3C show plan views of parts of platens corresponding to the inkjet heads shown in FIGS. 2A through 2C.
Figure 3B:
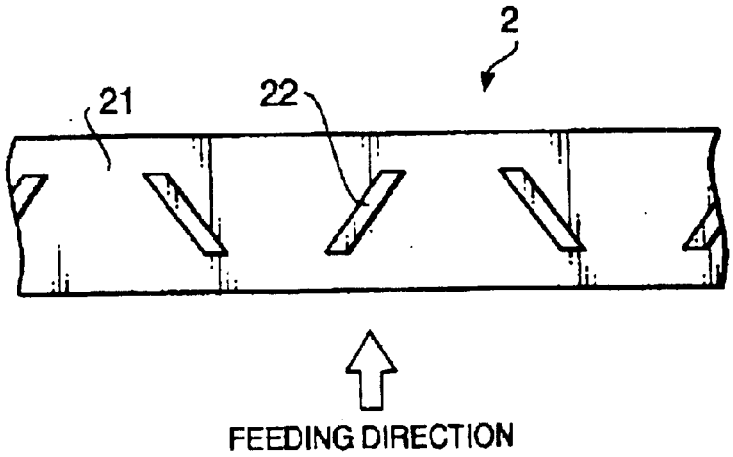
Figure 3C:
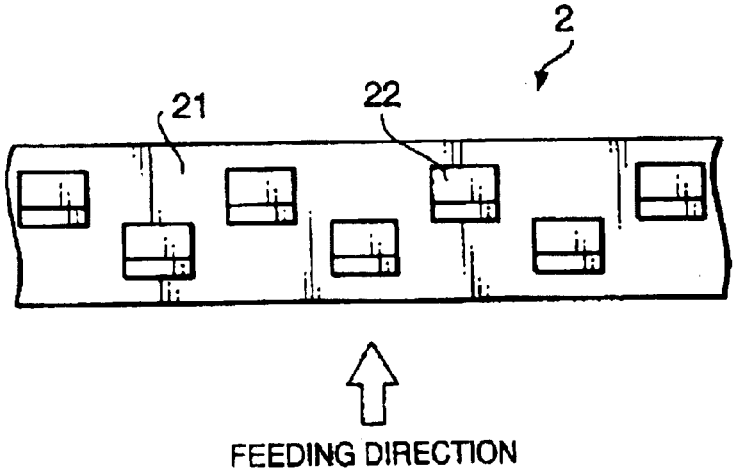

FIGS. 3A through 3C show plan views of parts of platens 2 respectively corresponding to the inkjet heads shown in FIGS. 2A through 2C. Each of the platens 2 is provided with protrusions 22. The shape and locations of the protrusions 22 correspond to the clearances between the nozzle groups 11 shown in FIGS. 2A through 2C. Specifically, the protrusions 22 shown in FIG. 3A face the clearances between the nozzle groups 11 shown in FIG. 2A, the protrusions 22 shown in FIG. 3B correspond to the clearances between the nozzle groups 11 shown in FIG. 2B, and protrusions 22 shown in FIG. 3C correspond to the clearances shown in FIG. 2C. The protrusions 22 function to support the recording medium 4. As shown in FIG. 1, the upper surface of each protrusion 22 is substantially at the same level as the upper surface of the frame 3.

The flushing operation is executed when the recording medium 4 does not exist between the inkjet head 1 and the platen 2. Since the protrusions 22 face the clearances between the nozzle groups 11, the ink ejected from the nozzle groups 11 when the flushing operation is executed attains a surface of a main body 21 of the platen 2 where the protrusions 22 are not located. Since the recording medium 4 is supported by the protrusions 22, even though the ink is ejected toward the main body 21 of the platen 2, the ink applied on the surface of the main body 21 does not pollute the back side of the recording medium 4. Therefore, the flushing operation can be executed only with delaying the feeding of the recording medium, and no further operation such as movement of an ink collecting member or the like is required.

As above, according to the configuration described above, even when the linear inkjet heads 1 are employed, the flushing operation can be performed without significantly decreasing the imaging speed, and the recording medium 4 can be supported by clean protrusions 22 when the imaging is executed.

The protrusions 22 may be formed separately from the main body 21 of the platen 2, and secured on the main body 21 of the platen 2. Alternatively, in view of the mechanical strength and productivity, it may be convenient to form the protrusions 22 integrally with the main body 21.

In order to allow the recording medium 4 to be fed smoothly, the protrusions 22 may be configured such that each upper surface thereof is inclined upward from the upstream side to the downstream side with respect to the feeding direction of the recording medium 4.

Optionally, at least side surfaces of each protrusion 22 may be formed to have water-shedding property (i.e., not wettable) so that the ink ejected by the flushing operation does not apply thereto. The upper surface of each protrusion 22 may also be configured to have the water-shedding property. In particular, if the water-shedding property of the upper surface of each protrusion 22 is superior to that of the side surfaces, it is ensured that the ink may not apply to the upper surface, and that the back surface of the recording medium 4 will not be polluted thereby.

In order to yield the water-shedding property, the protrusions 22 may be formed of material having the water-shedding property, or a water-shedding coating may be applied to the protrusions 22. As the material having the water-shedding property, fluorocarbon resin or silicon resin is known. As the water-shedding coating, the fluorocarbon resin coating may be employed. In order to differentiate the degree of the water-shedding property between the surfaces of the protrusions 22 and the other portions of the platen 2, surface roughness may be differentiated. That is, the surfaces other than those of the protrusions 22 may be finished to have rougher surfaces so as to be wet easily with the ink.

Figure 4:
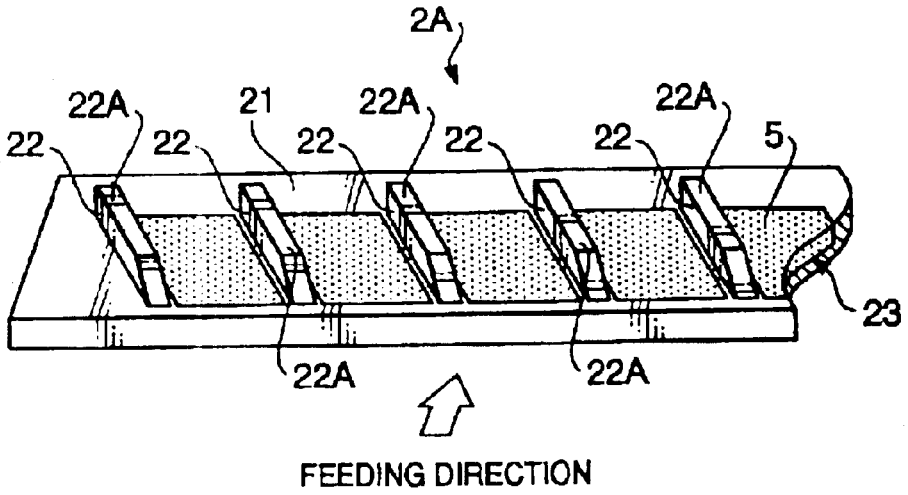
FIG. 4 shows a perspective view of an example of a part of platen according to an modification of the embodiment.

FIG. 4 shows a perspective view of an example of a part of platen 2A according to a modification of the embodiment. It should be noted that, in this example, the platen 2A is a modification of the platen 2 shown in FIG. 3A.

The platen 2A is provided with a plurality of protrusions 22 on an upper surface of the main body 21. Each of the protrusions 22 has an upper surface 22A inclined upward along the feeding direction of the recording medium 4. Between the protrusions 22, grooves 23 each having a shape of a parallelogram viewed from the top are formed. A porous member 5, which absorbs the ink, is inserted in each groove 23.

When the flushing operation is executed, the ink ejected by the nozzle groups 11 (see FIG. 2A) attain the porous members 5 and absorbed thereby immediately. The porous member 5 may be formed of foamed polystyrene, foamed polyurethane, foamed polyethylene, cancellous synthetic fabric (i.e., spongy) or the like. In view of immediate absorption of the ink, the foamed body has a continuous cellular structure. In this regard, viscose spongy or soft foamed urethane is preferably used. In view of a relatively long period of usage of the porous member 5, a structure for urging the porous members to exude the permeated ink and remove the same may optionally be provided.

It should be noted that the platens 2 shown in FIGS. 3B and 3B may also be modified to have the structure of the platen 2A described above.

Figure 5:
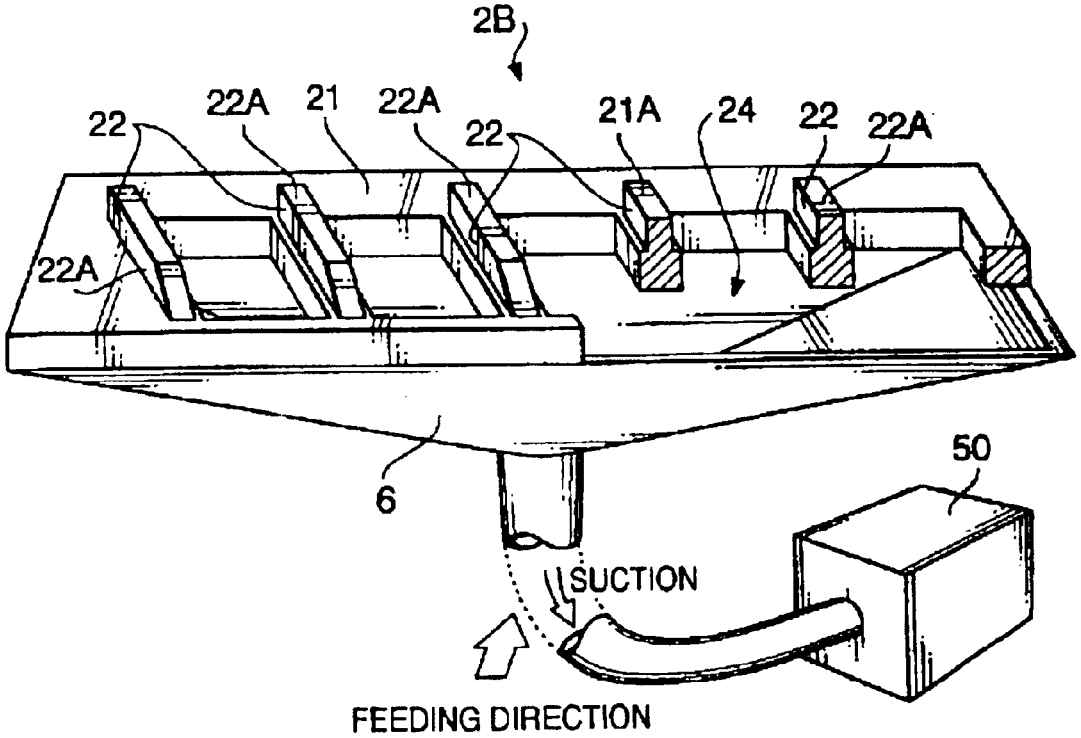
FIG. 5 shows a perspective view of another example of a part of platen according to a further modification of the embodiment.

FIG. 5 shows a perspective view of another example of a part of platen according to a further modification of the embodiment. The platen 2B is also a modification of the platen 2 shown in FIG. 3A.

The platen 2B is provided with a plurality of protrusions 22 on an upper surface of the main body 21. Each of the protrusions 22 has an upper surface 22A inclined upward along the feeding direction of the recording medium 4. Between the protrusions 22, through-openings 24 each having a shape of a parallelogram viewed from the top are formed.

Below the platen 2B, a suction duct 6 connected with a suction device 50 such as a suction fan, pump or the like is secured. When the flushing operation is performed, the suction device 50 is actuated so that the air above the platen 2B is sucked, through the through-openings 24, by the suction duct 6. The ink ejected from the nozzle groups 11 (see FIG. 2A) and ink mist floating between the platens 2B and the inkjet heads 1 are sucked by the suction device 50 immediately, through the through-openings 24, by the suction duct 6.

Optionally, porous members 5 may be provided at the through-openings 24 as in the structure shown in FIG. 4. In such a configuration, although the suction force to such the ink mist is weakened, the ejected ink can be absorbed quickly, and the absorbed ink can be discharged outside the platen 2B as sucked by the suction device 50. It should be noted that the through-openings 24 may be formed to coincide with the locations of the porous members 5. In such a configuration, it is ensured that the ink absorbed by respective porous members 5 can be removed. In the above described example shown in FIG. 5, one suction duct 6 receives the ink through a plurality of through-openings 24. This structure may be modified such that one suction mechanism is connected to each of the through-openings 24. Since the protrusions 22 function as partitions, if the suctions mechanisms connected to the through-openings 24 are driven individually, relatively strong suction force can be applied to respective through-openings 24. In such a configuration, a valve may optionally be proved in each suction mechanism to selectively or adjustably apply the suction force to the individual through-opening 24.

Optionally, a device for generating electrostatic may be provided to the inkjet recording apparatus as described above to electrize the main body of the platen so that the ink ejected from the nozzle groups 11 and the floating ink mist are electro-statically attracted by the main body of the platen. Alternatively, a pair of electrodes may be provided between the nozzle groups and the platens to generate the electrostatic so that the floating ink mist is attracted by the electrodes.

In the modification described with reference to FIG. 5, the through-openings 24 area formed between the protrusions 22 at positions corresponding to the nozzle groups 11, and the suction device 50 is connected through the suction duct 6. As in this modification, by combining the through-openings and the suction device, it is ensured that the ink ejected from the nozzle groups can be removed. However, the invention is not limited to such a configuration, and in some cases, the through-openings and the suction device may not be used together.

For example, only by forming the through-openings 24 between the protrusions 22, the ink can be removed, although the ink mist floating around the platens 2 may not be removed. In such a modification, similarly to the above-described embodiment and modifications, the upper surface 22A of each protrusion 22 may be inclined upward from the upstream side to the downstream side along the feeding direction of the recording medium 4.

Optionally, in such a structure, the porous members 5 maybe placed between the protrusions 22. Since the ink ejected from the nozzle groups 11 is immediately absorbed by the porous members 5, other portions of the platen may not be polluted with the ink. Further, via the through-openings 24, the ink can be discharged outside.

By differentiating the wettability (i.e., the degree of water-shedding property) with respect to the ink between the protrusions 22 and the porous members 5, and the porous members 5 is configured to have a structure and/or material which is more wettable than the protrusions 22, it is ensured that the ejected ink can be captured/absorbed by the porous members 5. Optionally, the protrusions 22 may be formed of material which is less wettable than the porous members 5. In such a case, even if the ejected ink attain a surface of the protrusion 22, the residual ink thereon can be minimized. In order to provide such a water-shedding property, as aforementioned, the protrusions 22 may be formed of water-shedding material or the water-shedding coating may be applied onto the surfaces of the protrusions 22.

The protrusions 22 divides the entire length of the platen 2 (2A, 2B). Further, when viewed from a direction in which the plurality of protrusions are aligned (i.e., when viewed along the width direction of the recording medium), the at least end portions of the protrusions next to each other overlap, therefore, the protrusions 22 function as partitions which prevent the ink ejected to the platen 2 from being spattered or flying off. Thus, the upper surface of the protrusions 22 are kept clean, and the back surface of the recording medium 4 supported by the protrusions 22 will not be polluted with the ink.

The present disclosure relates to the subject matter contained in Japanese Patent Application No. 2002-169642, filed on Jun. 11, 2002, which is expressly incorporated herein by reference in its entirety.

What is claimed is:

1. An inkjet recording apparatus that records an image on recording medium, the recording medium being fed in a predetermined direction which is perpendicular to a width direction of the recording medium, said inkjet recording apparatus comprising:

at least one inkjet head having a plurality of groups of nozzles that eject the ink; and a platen closely arranged to face said at least one inkjet head, said platen having a main body, wherein said plurality of groups are arranged in a width direction of the recording medium with predetermined clearances therebetween, wherein parts of said plurality of groups overlap when viewed from a direction in which the recording medium is fed so that said plurality of groups are continuously provided as a whole, and wherein a plurality of protrusions are formed on said main body of said platen at locations facing said clearances between said plurality of groups of said inkjet head.

2. The inkjet recording apparatus according to claim 1, wherein at least side surfaces of each of said protrusions are configured to repel the ink ejected from said groups of nozzles better than a surface of said main body at locations facing said groups of nozzles.

3. The inkjet recording apparatus according to claim 2, wherein an upper surface of each of said plurality of protrusions repels the ink at least the same degree as said side surfaces of each of said plurality of protrusions.

4. The inkjet recording apparatus according to claim 1, wherein ink absorbing members are arranged on said main body at locations facing said groups of inkjet nozzles, ink ejected from said plurality of groups being absorbed by said ink absorbing members.

5. The inkjet recording apparatus according to claim 4, wherein side surfaces of each of said protrusions are configured to have water-shedding property.

6. The inkjet recording apparatus according to claim 5, wherein an upper surface of each of said protrusion is configured to have a water-shedding property.

7. The inkjet recording apparatus according to claim 4, wherein said ink absorbing material is formed of porous material.

8. The inkjet recording apparatus according to claim 1, wherein said main body is formed of through-openings at locations corresponding to said plurality of nozzles of the inkjet head, the ink ejected from said plurality of nozzles being removed through said through-openings.

9. The inkjet recording apparatus according to claim 8, a plurality of ink absorbing members are provided at said plurality of through-openings, respectively.

10. The inkjet recording apparatus according to claim 9, wherein a suction device is connected to said main body, the ink ejected by said plurality of groups of nozzles being removed by suction through said through-openings and ink absorbing members.

11. The inkjet recording apparatus according to claim 8, wherein a suction device is connected to said main body, the ink ejected by said plurality of groups of nozzles being removed by suction through said through-openings.

12. The inkjet recording apparatus according to claim 8, wherein side surfaces of each of said protrusions are configured to have water-shedding property.

13. The inkjet recording apparatus according to claim 12, wherein an upper surface of each of said protrusion is configured to have a water-shedding property.

14. The inkjet recording apparatus according to claim 1, wherein side surfaces of each of said protrusions are configured to have water-shedding property.

15. The inkjet recording apparatus according to claim 14, wherein an upper surface of each of said protrusion is configured to have a water-shedding property.

16. The inkjet recording apparatus according to claim 15, wherein a degree of water-shedding property of said side surfaces and that of said upper surface are different.

17. The inkjet recording apparatus according to claim 14, wherein said protrusions are formed of water-shedding material.

18. The inkjet recording apparatus according to claim 14, wherein each of said protrusions is applied with a water-shedding coating.

19. The inkjet recording apparatus according to claim 1, wherein an upper surface of each protrusion is configured to incline upward along a feeding direction of the recording medium.

* * * * *